US005603536A

United States Patent [19]

Bauer et al.

[11] Patent Number: 5,603,536

[45] Date of Patent: Feb. 18, 1997

[54] LINEAR PRELOAD FLUID POWER OPERATED LATCH

[75] Inventors: David R. Bauer, Delafield; Michael P. Jahn, Greendale, both of Wis.

[73] Assignee: Applied Power Inc., Butler, Wis.

[21] Appl. No.: 534,229

[22] Filed: Sep. 26, 1995

[51] Int. Cl.[6] ..... E05B 47/00

[52] U.S. Cl. ..... 292/144; 292/37

[58] Field of Search ..... 292/37, 111, 129, 292/144, 252; 70/158, DIG. 48

[56] References Cited

U.S. PATENT DOCUMENTS

| | | | |
|---|---|---|---|
| 3,186,196 | 6/1965 | Moberg | 292/252 |
| 3,575,462 | 4/1971 | Riester | 296/65 |
| 3,602,019 | 8/1971 | Kazaoka | 70/264 |
| 3,622,197 | 11/1971 | Vogelei et al. | 296/146 |
| 3,624,761 | 11/1971 | Kohn | 180/112 |
| 3,753,316 | 8/1973 | Savarieau et al. | 49/31 |
| 3,889,576 | 6/1975 | Sheffer et al. | 91/394 |
| 3,945,670 | 3/1976 | Peterson | 292/92 |
| 4,033,161 | 7/1977 | Goes | 70/275 |
| 4,082,342 | 4/1978 | Ailshie et al. | 296/28 C |
| 4,163,583 | 8/1979 | Hammonds | 406/198 |
| 4,253,319 | 3/1981 | Feichtiger et al. | 70/264 |
| 4,279,321 | 7/1981 | Stone | 180/89.14 |
| 4,512,597 | 4/1985 | Nabb et al. | 292/143 |
| 4,522,359 | 7/1985 | Church et al. | 244/129.5 |
| 4,562,911 | 1/1986 | Manservisi et al. | 192/86 |
| 4,586,425 | 5/1986 | Redman et al. | 91/45 |
| 4,609,215 | 9/1986 | Self et al. | 292/144 |
| 4,643,468 | 2/1987 | Oen | 292/2 |
| 4,647,089 | 3/1987 | Zangrando | 292/144 |
| 4,667,990 | 5/1987 | Quantz | 292/201 |
| 4,681,286 | 7/1987 | Church et al. | 244/129 |
| 4,763,875 | 8/1988 | Chew | 251/149.9 |
| 4,819,983 | 4/1989 | Alexander et al. | 296/121 |
| 4,838,298 | 6/1989 | Cleasby | 137/110 |
| 4,866,963 | 9/1989 | Leininger et al. | 70/278 |
| 4,881,766 | 11/1989 | Schmidt et al. | 292/201 |
| 4,982,984 | 1/1991 | Yokota et al. | 291/201 |
| 5,007,261 | 4/1991 | Quantz | 70/240 |
| 5,056,343 | 10/1991 | Kleefeldt et al. | 70/264 |
| 5,109,812 | 5/1992 | Erickson et al. | 123/90.12 |
| 5,152,260 | 10/1992 | Erickson et al. | 123/90 |
| 5,253,619 | 10/1993 | Richeson et al. | 123/90.12 |
| 5,259,345 | 11/1993 | Richeson | 123/90.12 |
| 5,332,353 | 7/1994 | Arnold | 414/723 |
| 5,413,402 | 5/1995 | Flerchinger et al. | 298/23 |

FOREIGN PATENT DOCUMENTS

| | | | |
|---|---|---|---|
| 1554478 | 1/1970 | Germany | 292/144 |

*Primary Examiner*—Steven N. Meyers
*Assistant Examiner*—Donald J. Lecher
*Attorney, Agent, or Firm*—Quarles & Brady

[57] ABSTRACT

A linear preload fluid power operated latch has two coaxial pistons, one slidable inside the other and the other slidable within a cylinder. The one piston slides inside the other to cam dogs which are slidable in slots of a nose which is secured to the other piston so as to engage an undercut in a cup in which the nose is received. After the dogs are engaged in the cup, which secures the latch, both pistons are retracted to apply a linear preload force between the two bodies being latched. In one embodiment, the pistons are moved in both directions under fluid pressure and in another embodiment, both pistons are returned by compression springs. In either case, the cup is drawn closer to the cylinder with a certain preload force, to latch a body to which the cup is attached to a second body to which the cylinder is attached with that preload force. An elastomeric isolator is interposed-between the one body and the cup so as to attenuate the transmission of vibrations from the cup to the body or vice versa, and also to provide lateral and vertical compliance for helping to align the cup and locking unit with one another.

11 Claims, 4 Drawing Sheets

LINEAR PRELOAD FLUID POWER OPERATED LATCH

BACKGROUND OF THE INVENTION

1. Field of the Invention

This invention relates to latches for positive interlocking of two structures together, and in particular to such a latch which is fluid power operated.

2. Discussion of the Prior Art

Many different types of latches are well known. For example, in the case of a car or truck, there is a latch for holding the hood shut, one for holding the trunk shut, and latches for holding the door shut. These latches are typically spring operated and are actuated under the power of the user shutting the hood, trunk or door. However, some are electrically powered, which typically are electrically powered only to supply the final closing motion after the two parts have been brought together sufficiently to mechanically inter-lock them.

Particularly for large structures, which are somewhat nonrigid or flexible when unlatched, it is desirable for the latch to provide for a certain amount of misalignment during the engagement process. In cars, the misalignment is usually not too severe, since the doors, hood and trunk are usually small enough so that they are quite rigid. However, in large trucks, the hood can be very large and quite flexible such that misalignment between it and the truck body when it is shut can be a problem. Latches of the type using a pin which is caught by a hook can be aligned by being received in a V-shaped groove, although this provides alignment in only one direction. It is desirable to provide alignment in all directions to insure proper fitting of the two parts together time after time.

It is also desirable in such large structures to provide automatic latching and pre-load, since it may be difficult for the user to cause the latch or latches to catch, prior to the pre-load being applied automatically. It is also desirable for a latching mechanism to do this using available power sources, which are reliable and maintain the latch between the part in the event that a power failure is experienced.

SUMMARY OF THE INVENTION

The invention provides a fluid power operated latch, including a fluid pressure operated cylinder with an annular piston having an inner diameter and an outer diameter, the outer diameter being slidably sealed to an internal wall of the cylinder. A quill shaft is secured to the annular piston and extends axially therefrom beyond an end of the cylinder to an extending end, the quill shaft having a hollow nose at the extending end. A second piston is slidably sealed to the inner diameter of the annular piston and a post is secured to the second piston which extends axially therefrom inside a lumen of the quill shaft. The post is slidable inside the lumen and extends beyond the cylinder to an extending end inside the nose and has a linear cam at the extending end. At least one dog is slidable radially in and beyond a slot in the nose by being slidable in the slot by camming on the cam when the cam is moved axially. A cup for receiving the nose has an undercut for engaging the dog when the dog extends radially beyond the nose to resist retraction of the nose from the cup. Thus, a power latch is provided which addresses the above concerns.

In a preferred aspect, the nose tapers toward an end thereof and a bottom of the cup is bell-shaped. Such shapes facilitate aligning the nose and cup upon initial engagement.

In addition, a soft mounting of the cup is preferably provided by an elastomeric isolator, to provide compliance during alignment and also attenuate the transmission of vibration.

In another useful aspect, in a retracted position of the pistons the dog cams on the undercut to press against the linear cam. Friction between the cam, the dog and the undercut maintains the latch connection, even in the event of a power failure.

A latch of the invention may be a spring return, in which it would include a spring for returning the annular piston and a spring for returning the second piston relative to the annular piston, or it may be double acting under fluid pressure. If double acting, the effective area of the quill shaft is preferably at least two times the effective area of the post to insure that latching takes place before retraction of the quill shaft and nose begins.

Other features and advantages of the invention will be apparent from the drawings and detailed description.

DETAILED DESCRIPTION OF THE PREFERRED EMBODIMENTS

Figure 1:
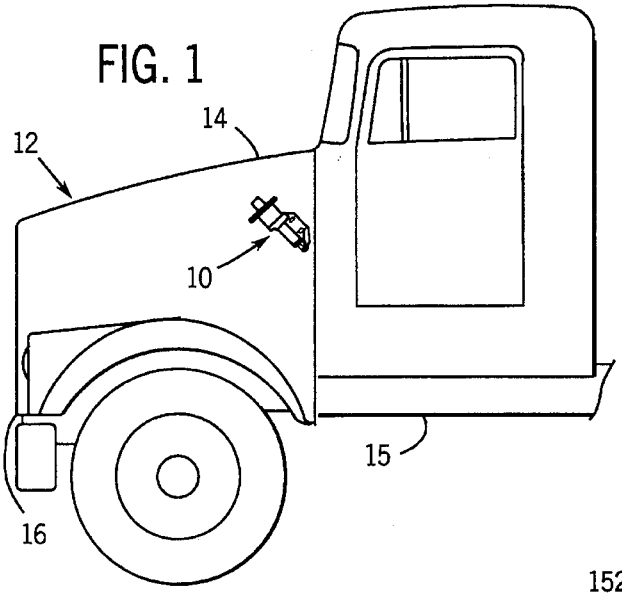
FIG. 1 illustrates the general position of a latch of the invention installed to latch the hood of a semi-truck.

FIG. 1 illustrates a large semi-truck 12 which would incorporate one or more latches 10 of the invention. In the truck 12, the hood 14 would be hinged to the truck chassis 15 at the front edge 16 thereof. Preferably, one latch 10 would be provided on each side of the hood 14 to lock it closed, for a total of two such latches.

Figure 2:
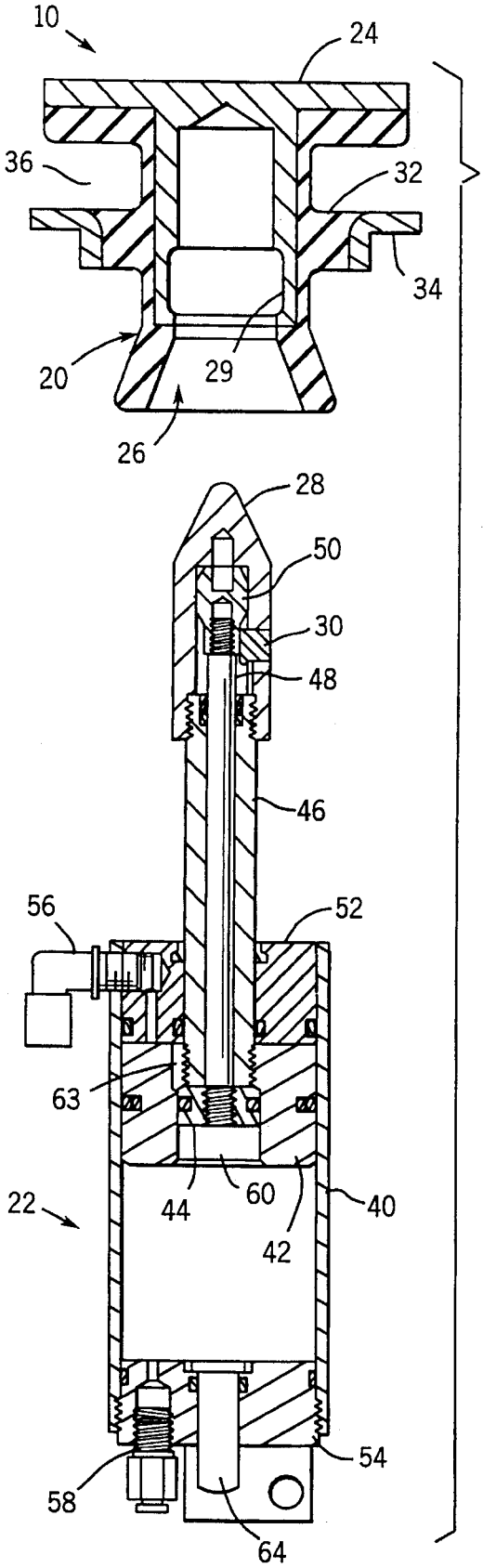
FIG. 2 is a cross-sectional view of the latch shown in a position in which the hood would be open.

Referring to FIG. 2, the latch 10 has two main parts. These are the cup 20 and the locking unit 22. The cup 20 is secured to the hood 14 and the locking unit is secured to the chassis or the body of the truck 12 by any suitable means, for example, by bolts (not shown).

Preferably, as shown, the cup 20 has a steel body 24 which defines an internal generally cylindrical recess 26 into which the nose 28 of the locking unit 22 is received. The lower portion of the body 24 is bell shaped and the end of nose 28 tapers to a point so that as the nose 28 enters the cup 20, the nose 28 slides against the bell shaped bottom of the body 24 to laterally align the nose 28 with the cup 20. The recess 26 has within it an undercut 29 which is used for engaging a dog 30 of the locking unit 22, as will be further described below.

The body 24 may be mounted directly to the hood of the truck, but preferably an elastomeric isolator 32 is interposed around the body 24, to cut down on the transmission of higher frequency vibrations and to give lateral and axial compliance to the body 24, so that it can move a limited amount laterally and axially to provide for alignment with nose 28, if need be. A steel flange 34 may be provided radially outward of the isolator 32 and the flange 34 secured to the truck hood by any suitable means, for example by bolts. Alternatively, a wall of the truck hood could be sandwiched in the annular space identified by 36 to capture the cup 20 relative to the hood of the truck, although this would provide less compliance than if the flange 34 were secured and the body 24 allowed a clearance with the surrounding structure of the body and cab.

The locking unit 22 includes a cylinder 40, first 42 and second 44 coaxial pistons, a quill shaft 46 secured by a threaded connection to the first annular piston 42 and a post 48 secured by a threaded connection to the second piston 44. The post 48 is axially slidable inside the lumen of the shaft 46. The nose 28 is screwed onto the quill shaft 46 to form a part of the extending end thereof, and a linear cam 50 is secured to the post 48 at the extending end thereof, inside of the nose 28. One or more dogs, (preferably three, equi-angularly spaced, see FIG. 6) are provided which slide axially in slots of the nose 28 under the influence of linear cam 50. Ends 52 and 54 seal off the ends of cylinder 40 and ports 56 and 58 provide for the admission and escape of fluid from the cylinder 40, on opposite sides of the pistons 42 and 44.

The ends 52 and 54 are sealed to the cylinder 40 with appropriate seals, and a sliding seal is established between the quill shaft 46 and the end 52 with appropriate seals, as is well known in the art. The post 48 is slidable within the quill shaft 46 as is the linear cam 50 slidable within the nose 28. In the position of the post 48 relative to the quill shaft 46 shown in FIG. 2, the dogs 30 are able to retract into the nose 28, whereas in the position of the post 48 relative to the quill shaft 46 shown in FIG. 4, the dogs 30 are pushed radially outwardly so they extend slightly beyond the nose 28 to catch on the undercut 29 of the cup 20.

The outer diameter of the annular piston 42 is slidably sealed inside the cylinder 40 so as to reciprocate axially relative to the cylinder 40 under the influence of fluid pressure admitted into the cylinder 40 by either port 56 or port 58. A sliding seal is established between the second piston 44 and the walls of the chamber 60 defined by the inner diameter of the annular piston 42 so that the piston 44 can reciprocate axially relative to the annular piston 42 under the influence of fluid pressure admitted by either port 56 or port 58. Fluid enters and exits the chamber 60 from the rod side (or top side as viewed in FIGS. 2–4) of piston 42 through passageway 63 formed in the annular piston 42.

Figure 3:
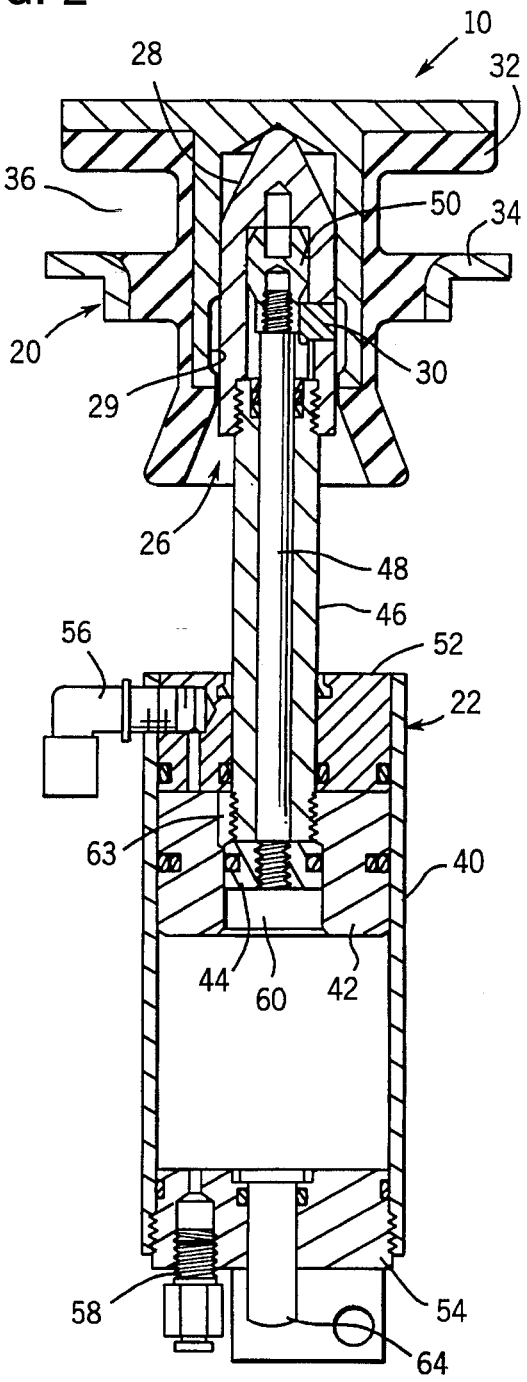
FIG. 3 is a view similar to FIG. 2 but shown in a position in which the hood is closed and the latch is unlatched.

When pressure is admitted by port 58 and relieved by port 56 by appropriate valving (not shown), the locking unit 22 assumes the position shown in FIG. 2, in which the quill shaft 46 and post 48 are fully extended. The cup 20 is then brought down into close proximity to the nose 28, for example by a person shutting the hood, and the tapered shape of the nose 28 and bottom bell shape of the cup 20 serve to align the nose and cup so as to be co-axial, so that the nose can be received within the cup as shown in FIG. 3. Once that has occurred, pressure is admitted to port 56 and pressure is relieved from port 58. This pressure is provided by an external source, i.e., the hydraulic or pneumatic pump of the truck 12, which is not shown. In the preferred embodiment, hydraulic is the preferred type of fluid supply pressure.

Upon admission of pressure by port 56 to the rod side (as viewed in FIGS. 2–4) of the pistons 42 and 44, the piston 44 first moves downwardly relative to the piston 42, until the linear cam 50 abuts the upper end of the quill shaft 46. As the linear cam 50 is pulled downwardly within the nose 28, it cams on the dogs 30, which urges them outwardly to the position shown in FIG. 4, in which they engage undercut 29 of the cup 20. Thereby, the locking unit 22, specifically the nose 28 of the locking unit 22, and the cup 20 are fixed together by the engagement of the dogs 30 with the undercut 29 inside the cup 20. As more fluid is admitted to the cylinder 40 on the upper side of the pistons 42 and 44, it urges the pistons 42 and 44 downwardly within the cylinder 40, to retract the quill shaft 46 and post 48, thereby pulling the cup 20 closer to the cylinder 40 until the relative position of the cup 20 and cylinder 40 is reached shown in FIG. 4.

In this position, the bottom of the cup 20 abuts the cylinder end 52 with a certain preload force, determined by the pressure of the fluid inside the cylinder 40 and the size of the piston area the fluid acts on. To release the cup 20 from the locking unit 22, pressure is admitted to port 58 and relieved from port 56. When this occurs, the first thing that happens is the second piston 44 moves upwardly relative to the annular piston 42 to move the linear cam 50 up out of the way of the dogs 30 so that they may retract into the nose 28. With them retracted into the nose 28, the undercut 29 can clear the dogs 30, so that when the hood is lifted the cup 20 releases the nose 28. However, after the dogs 30 are released from the cup 20, if more fluid is admitted beneath the pistons 42 and 44 into the cylinder 40, it lifts the pistons 42 and 44 to the positions shown in FIGS. 2 and 3, to push the cup 20 away from the cylinder 40, thereby initiating the opening of the hood or other structural body.

When the pistons 42 and 44 are both in the extended positions shown in FIGS. 2 and 3 and fluid pressure is thereafter admitted to port 56, piston 44 moves to the retracted position (relative to piston 42) before piston 42 begins to move. This is a result of the balance of fluid pressure and friction forces acting on the pistons 42 and 44. The friction force at the cylindrical interface between the piston 44 and the piston 42 acts to oppose the motion of the piston 44 relative to the piston 42 and acts to move the piston 42 relative to the cylinder 40. Another friction force acts at the cylindrical interface between the piston 42 and the cylinder 40 to oppose motion of the piston 42 relative to the cylinder 40.

When fluid pressure is first admitted to port 56 when both pistons are in the extended position shown in FIGS. 2 and 3, there will still be fluid pressure in the cylinder 40 on the side of the pistons 42 and 44 which is opposite from the rod side, hereinafter referred to as the piston side (the piston side is the lower side as viewed in FIGS. 2–4). To insure that fluid pressure is maintained on the piston side as fluid is being admitted to the rod side, a one-way orifice (not shown) is preferably incorporated into the hydraulic line connected to port 58 to restrict the flow of fluid exiting from the cylinder on the piston side of the pistons 42 and 44. This restriction therefore determines the speed with which the pistons 42 and 44 retract. A restriction may also be placed in the fluid line leading from port 56 to restrict the flow of fluid exiting from the rod side of the cylinder 40, to restrain the speed with which the pistons 42 and 44 advance to the extended position.

Thus, a certain pressure will be acting on the piston side of the pistons which acts on the areas of the pistons on the piston side to generate forces which oppose the retraction of the pistons. The pressure acting on the rod side of the pistons will be equal to (or slightly greater to make up for friction, which is negligible) than the pressure on the piston side. If $A_1$ is the circular cross-sectional area of the chamber in cylinder 40 in which the pistons 42 and 44 reciprocate (i.e., $A_1$ is equal to the sum total of the annular area of piston 42 plus the circular area of piston 44), $A_2$ is the circular area of piston 44, $A_3$ is the effective area of the post 48, which is the circular cross-sectional area of the post 48, and $A_4$ is the effective area of the quill shaft 46, which in the preferred embodiment is the area of a circle equal in diameter to the outer diameter of the quill shaft 46, the pressure acting on the piston (or lower side as viewed in FIGS. 2–4) side of the pistons 42 and 44 is $P_p$ and the pressure acting on the rod side (or upper side as viewed in FIGS. 2–4) of the pistons 42 and 44 is $P_r$, the fluid force $F_{42}$ on the piston 42 is described as follows (positive denotes an upward force, toward extension, and negative denotes a downward force, toward retraction):

$$F_{42}=P_p(A_1-A_2)+P_r(A_2-A_3)-P_r(A_1-A_4); \quad (1)$$

which, if the assumption is made that $P=P_p=P_r$ simplifies to:

$$F_{42}=P(A_4-A_3). \quad (2)$$

The fluid force $F_{44}$ acting on the piston 44 is described as follows:

$$F_{44}=P_pA_2-P_r(A_2-A_3); \quad (3)$$

which, again making the assumption that $P=P_p=P_r$, simplifies to:

$$F_{44}=PA_3. \quad (4)$$

As used herein, "effective area" means the area on which fluid pressure acts or is prevented from acting.

For the piston 42 to remain stationary and the piston 44 to retract before the piston 42 starts to retract at the initiation of fluid into port 56, the upward force on the piston 42 must be greater than the upward force on the piston 44. Comparing equations (2) and (4), for the upward force on the piston 42 to be greater than the upward force on the piston 44, the area $A_4$ must be at least two times the area $A_3$, i.e.:

$$A_4>2A_3. \quad (5)$$

The previous paragraph describes the relationship of the areas $A_4$ and $A_3$ necessary for the situation before the linear cam 50 bottoms against the quill shaft 46. When that occurs, the piston 44 has reached the end of its retraction stroke relative to the piston 42 and additional force is applied to the piston 42 tending to move it downward, as fluid is squeezed out of the piston side of the cylinder. For this part of the retraction stroke, the pistons 42 and 44 move in unison, and the equation describing the force $F_{42,44}$ on the combined piston 42, 44 is:

$$F_{42,44}=P_pA_1-P_r(A_1-A_3); \quad (6)$$

which, again making the assumption that $P=P_p=P_r$, simplifies to:

$$F_{42,44}=PA_3. \quad (7)$$

Figure 4:
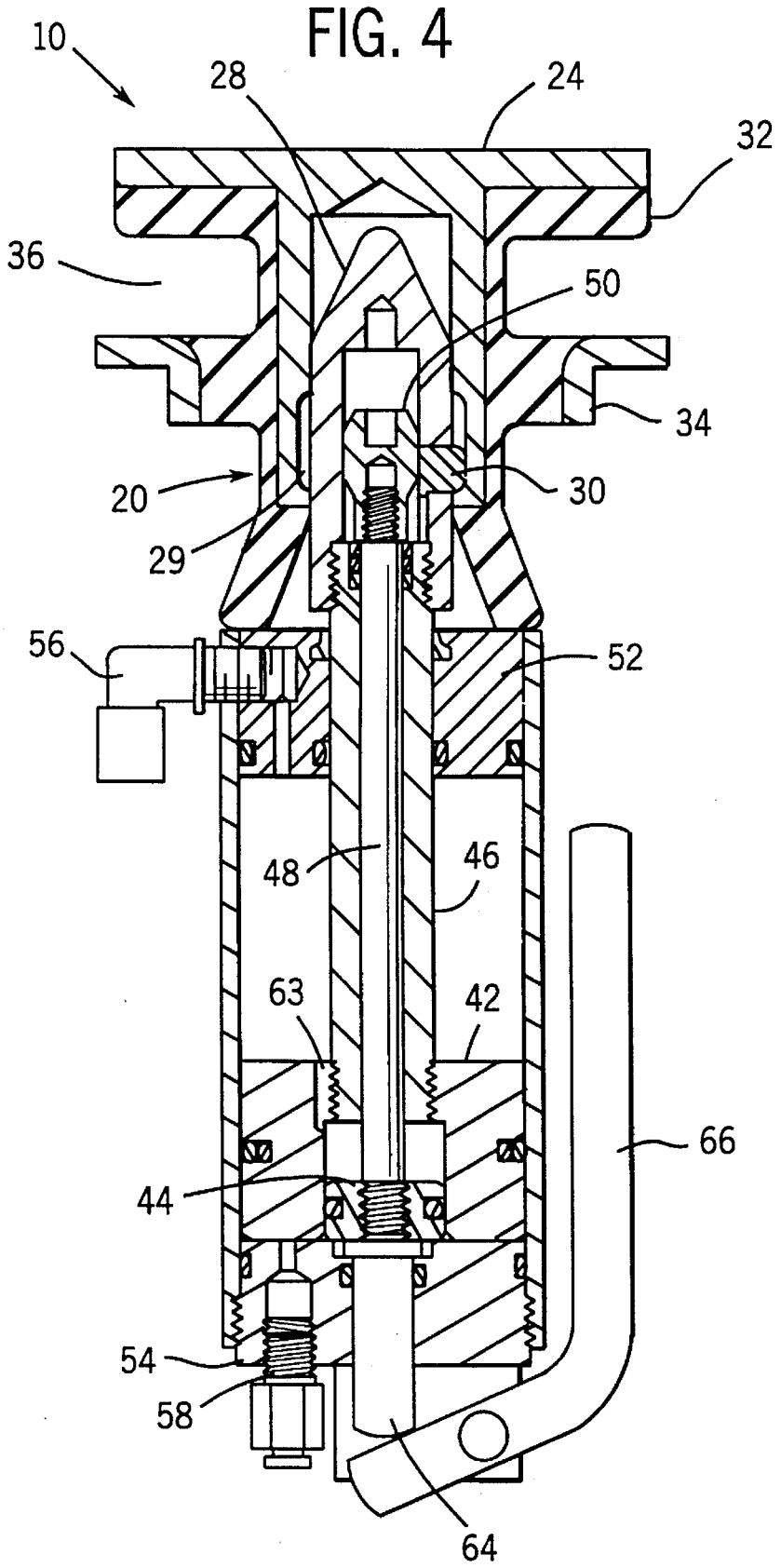
FIG. 4 is similar to FIG. 3 but shows the latch in a latched position.

This equation continues to describe the force on the combined piston 42, 44 until it reaches the bottom of its retraction stroke, shown in FIG. 4. However, it should be noted that it may reach the bottom of its retraction stroke before it reaches the position shown in FIG. 4. For example, weatherstripping (sometimes referred to as a "bulb seal") may line the interface between the hood and body, which is typically a compressible strip which is intended to be compressed between the hood and body to create a preload between them. This preload is transferred to the connection established between the cup 20 and the locking unit 22 to create a tensile preload in the shaft 46. This preload may or may not stop the retraction of the pistons 42 and 44 before they reach their bottomed out position, shown in FIG. 4, in which the cup 20 actually interferes with the cylinder 40, as further described below.

As this preload between the latching unit 22 and the cup 20 is established, the pressure builds on the rod side of the pistons 42 and 44 and the dogs 30 cam on their radially outer ends against the lower (or near) end of the undercut 29, which jams the dogs against the cam 50, to create appreciable friction between the cam 50, the dogs 30 and the undercut 29. For this purpose, the near end of the undercut preferably is radiused or otherwise shaped to taper radially inwardly toward the bottom, so as to cam on the outer ends of the dogs 30 in this manner. In the event of a power failure, so that atmospheric pressure would occupy the cylinder 40 on both sides of the pistons 42 and 44, the frictional engagement generated by this inward camming of the dogs 30 on the undercut 29 would maintain the dogs 30 engaged with the undercut 29. In addition, the upper (or far) end of the undercut 29 may be shaped to cam the dogs 30 radially inwardly on the extension stroke, so as to cam the dogs 30 fully inwardly on the extension stroke of the pistons 42 and 44, so that they do not interfere with the removal of the cup 20 from the nose 28.

On the initiation of the extension stroke, the piston 44 does not initially move relative to the piston 42 until the tensile preload described above is substantially removed, for example by lifting enough to decompress the bulb seal. This is because the friction between the cam 50, dogs 30 and undercut 29 is sufficient to restrain the piston 44 relative to the piston 42. However, after that occurs and the locking unit begins to lift the cup 20, the dogs 30 will cam up on the undercut 29 and thereby relieve the frictional force restraining the piston The piston 44 will then move relative to the piston 42 since the force required to move it upwardly is less than the force required to move the piston 44 upwardly, as determined by equations (2) and (4) above, respectively. After the piston 44 tops out relative to the piston 42, both pistons 42 and 44 will move in unison to the fully extended position shown in FIG. 3, so that the cup 20 may be removed from the locking unit 22.

FIGS. 2–4 also disclose a pin 64 slidably sealed in the cylinder end 54 and extending beneath the cylinder end. FIG. 4 illustrates a manual override lever 66 which is pivotally connected to the cylinder end 54 so as to push pin 64 upwardly. When the second piston 44 is in the position shown in FIG. 4, pushing the pin 64 upwardly by rotating the lever 66 manually pushes the piston 44 upwardly relative to the piston 42, to release the dogs 30. The lever 66 and pin 64 are therefore provided in case of a power loss, so that the latch 10 may be manually released.

The latch 10 provides complete positive interlocking of the cup 20 and locking unit 22. Although it has been described with respect to the hood of a truck in the preferred embodiment, it should be noted that latch 10 could be used to provide interlocking between any two structures or bodies. In addition, it should be noted that the latch 10 provides for significant lateral misalignment during the engagement process and not only interlocking of two bodies, but also preloading. Since the cup 20 is drawn toward cylinder end 52 under the influence of fluid admitted to port 56 with a certain preload force, if the two bodies abut one another before the cup 20 abuts the end 52, that preload force is exerted on the bodies, to tightly hold them together. Even with the preload force applied in this manner, the cup 20 may still abut the end 52. For example, in the truck hood latching application illustrated, the hood abuts and compresses the bulb seal around it with the preload force, to maintain the hood tightly closed against the bulb seal and body, and continues compressing the bulb seal until the cup 20 abuts the cylinder end 54.

The unit 10 also provides for significant axial advance and retraction between the two bodies, to initiate the opening and closing motions. Also, the elastomeric isolator provides for lateral and vertical compliance of the connection between the two bodies which are latched by the unit 10, when such compliance is required. Moreover, latching is maintained in the event of a power loss.

Figure 6:
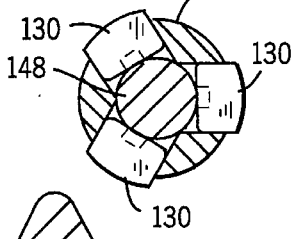
FIG. 6 is a cross-sectional view as viewed from the plane of the line 6—6 of FIG. 5.
Figure 5:
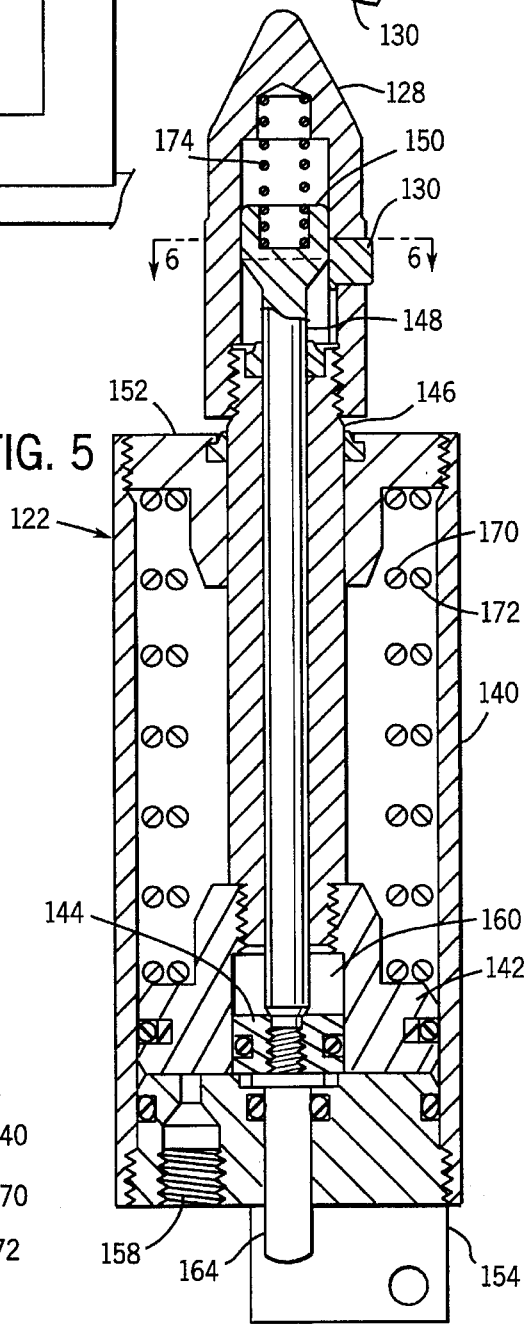
FIG. 5 is a cross-sectional view illustrating a second embodiment of a locking unit for a latch of the invention.

FIGS. 5 and 6 illustrate a second embodiment of a locking unit, 122 which is essentially the same as the first embodiment 22, except as described below. In the locking unit 122, elements corresponding to the first embodiment 22 are identified with the same reference numeral plus 100.

The locking unit 122 differs from the locking unit 22 in that it is not retracted by fluid pressure and therefore has no port 56, but is retracted under the action of a pair of co-axial compression springs 170 and 172. Also, the linear cam 150 is integral with the post 148 in the locking unit 122, whereas in the locking unit 22 the linear cam 50 is threaded on to the end of the post 48. The cam 150, post 148 and piston 144 are moved into the retracted (or engaged) position by a third spring 174, which extends between the nose 128 and the cam 150 and is substantially weaker than the springs 170 and 172, so that less force is needed to move the piston 144 up than the force needed to move the piston 142 up. Also, the piston 142 has a somewhat different shape than the piston 42 and has no passageway 63.

Since the locking unit 122 is retracted by the springs 170, 172, and the piston 144 is retracted relative to the piston 142 by the spring 174, the pistons 142 and 144 only move under fluid pressure in one direction, i.e., the extending direction, it is known as a single acting spring return locking unit 122. In the embodiment 22, since it is moved in both directions under fluid pressure, it is a double acting locking unit. The cup 20 used with the locking unit 122 can be identical to the cup 20 used with the first embodiment 22. Although a manual override lever 66 is not shown in FIG. 5, it should be understood that one could be provided in the manner shown in FIG. 4.

Figure 7:
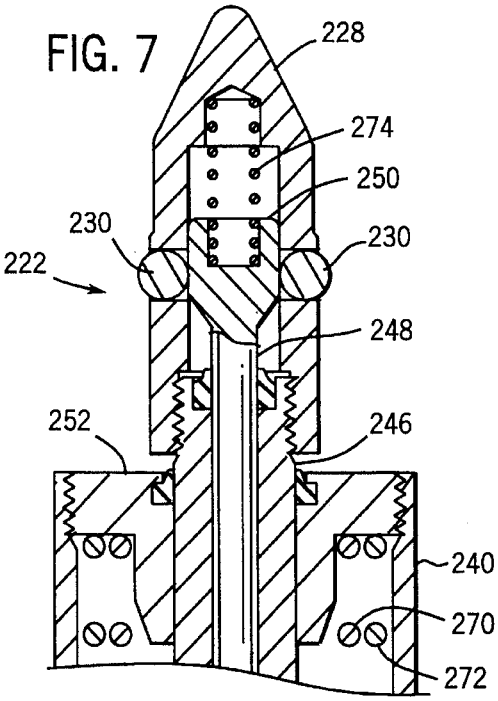
FIG. 7 is a fragmentary view illustrating a modification to the embodiment of FIG. 5.

FIG. 7 illustrates a variation 222 of the unit 122, which is the same in all respects as that shown in FIG. 5, although the dogs 130 are provided in the form of balls 230, rather than the shape shown in FIGS. 5 and 6. If provided as balls, the exterior ends of the holes in which the balls are received would be coined or otherwise reduced in diameter to prevent the balls from falling out. The elements of the embodiment 222 corresponding to the elements in the unit 122 are identified with the same reference number, plus 100.

Figure 8:
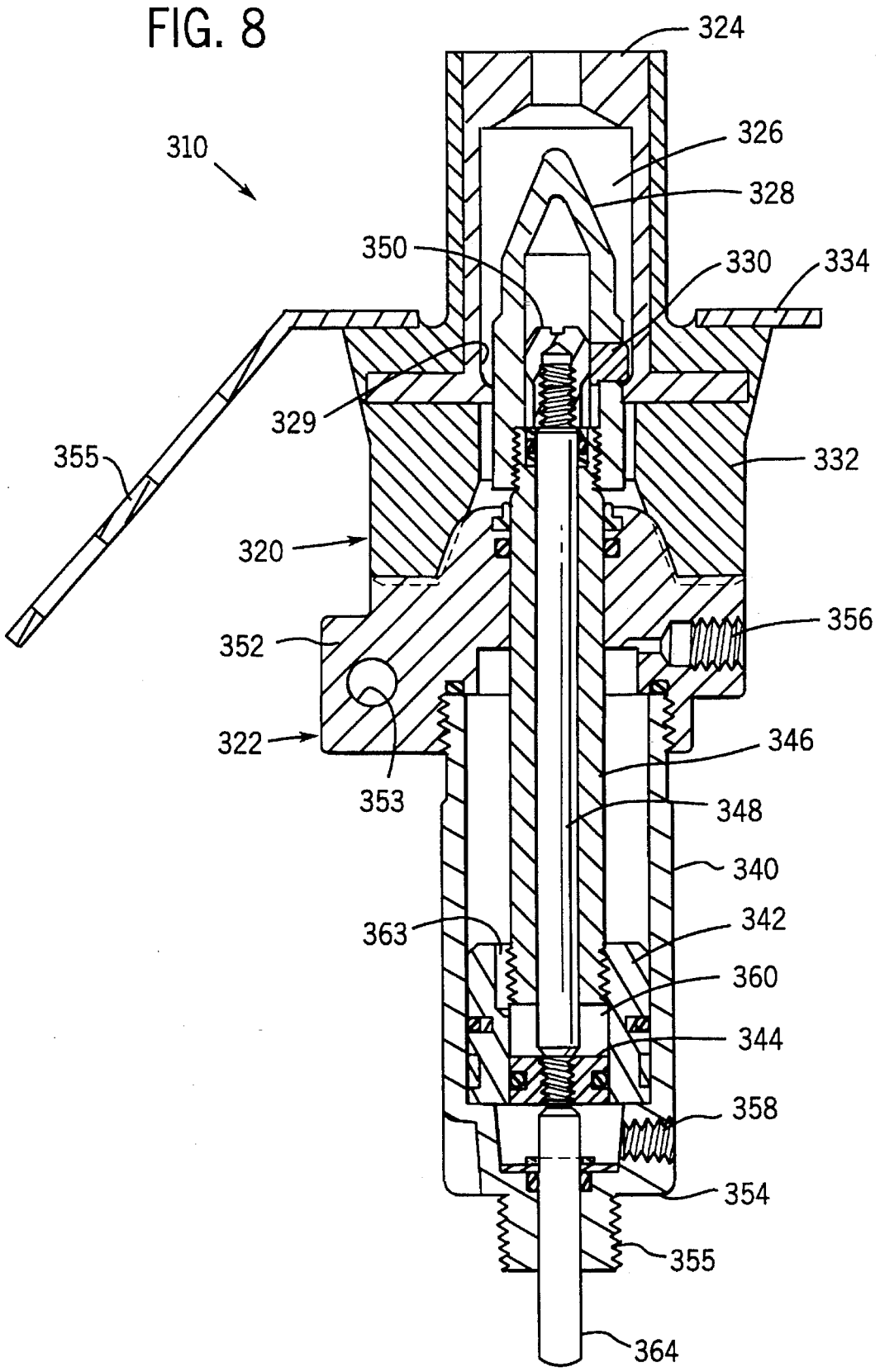
FIG. 8 is a cross-sectional view of another embodiment of a locking unit for a latch of the invention.

FIG. 8 illustrates a fourth embodiment of a locking unit 322 and a second embodiment of a cup 320, in which elements corresponding to elements of the first embodiment 10 have been labelled with the same reference number, plus 300. The lower end 354 is made integral with the cylinder 340, port 358 formed in the side of the end 354, and port 356 is formed in the side of the end 352, into which cylinder 340 is screwed. End 354 is provided with threads 355 and end 352 is provided with hole 353 for mounting the locking unit 322 to the truck body or chassis or other structure. Threads 355 may also be used for mounting a bracket on which a lever similar to the lever 66 could be pivotally mounted, for manually releasing the latch 310.

The cup 320 includes body 324, elastomer 332 encasing the body 324 and also flange 334. The elastomer 332 extends beneath body 324 and widens at the bottom to form a bell-shaped opening to receive and help align the nose 328 with the interior of the body 324. The elastomer 328 would therefore contact the end 352 and be compressed against it as shown if the stroke of cylinder 340 and the fit of the parts drawn together permitted it. The flange 334 has an arm 335 which is provided with two holes for mounting the cup 320 to the hood or other structure.

Preferred embodiments of invention have been described in considerable detail. Many modifications and variations to these embodiments will be apparent to those skilled in the art which will be within the spirit and scope of the invention. Therefore, the invention should not be limited to the preferred embodiments described, but should be defined by the claims which follow.

We claim:

1. A fluid power operated latch, comprising:

a fluid pressure operated cylinder;

a fluid pressure operated annular piston having an inner diameter and an outer diameter, said outer diameter being slidable relative to an internal wall of said cylinder and sealed thereto;

a quill shaft secured to said annular piston and extending axially therefrom beyond an end of said cylinder to an extending end, said quill shaft being extendable and retractable relative to said cylinder and having a hollow nose at said extending end;

a second fluid pressure operated piston slidably sealed to said inner diameter of said annular piston;

a post secured to said second piston and extending axially therefrom inside a lumen of said quill shaft, said post being slidable inside said lumen so as to be extendable and retractable relative to said quill shaft and extending beyond said cylinder to an extending end inside said nose and having a linear cam at said extending end;

at least one dog slidable radially in and beyond a slot in said nose, said dog being slidable in said slot by camming on said cam when said cam is moved axially relative to said quill shaft; and a cup for receiving said nose and having an undercut for engaging said dog when said dog extends radially beyond said nose to resist retraction of said nose from said cup.

2. A latch as claimed in claim 1, wherein said nose tapers toward an end thereof.

3. A latch as claimed in claim 1, wherein a bottom of said cup is bell-shaped.

4. A latch as claimed in claim 1, wherein said cup includes an elastomeric isolator for mounting said cup.

5. A latch as claimed in claim 1, wherein in a retracted position of said pistons said dog cams on said undercut to press against said linear cam.

6. A latch as claimed in claim 1, further comprising a spring for returning said annular piston.

7. A latch as claimed in claim 6, further comprising another spring for returning said second piston relative to said annular piston.

8. A latch as claimed in claim 7, wherein said other spring biases said second piston toward a position in which said cam urges said dog radially outwardly.

9. A latch as claimed in claim 1, wherein said cylinder is double acting.

10. A latch as claimed in claim 9, wherein the effective area of said annular piston is at least two times the effective area of said second piston.

11. A latch as claimed in claim 1, further comprising a lever mounted to said cylinder for manually disengaging said dog from said undercut.

* * * * *